United States Patent [19]

Pfleger

[11] 4,099,459

[45] Jul. 11, 1978

[54] INERTIA PRINTING MEMBER

[76] Inventor: Frederick W. Pfleger, 1152 Barbara Dr., Cherry Hill, N.J. 08034

[21] Appl. No.: 739,067

[22] Filed: Nov. 5, 1976

[51] Int. Cl.[2] ..... B41F 17/00

[52] U.S. Cl. ..... 101/35; 101/41; 101/376

[58] Field of Search ..... 101/35, 41, 44, 375–377, 101/36, 37

[56] References Cited

U.S. PATENT DOCUMENTS

| | | | |
|---|---|---|---|
| 1,284,031 | 11/1918 | Ahlburg | 101/37 X |
| 1,420,187 | 6/1922 | Douglas | 101/44 |
| 2,184,510 | 12/1939 | Adams | 101/35 X |
| 2,866,402 | 12/1958 | Jezerski et al. | 101/35 |
| 2,923,232 | 2/1960 | Worth | 101/35 |
| 2,935,015 | 5/1960 | Wilson et al. | 101/44 |
| 2,935,933 | 5/1960 | Moeller | 101/44 |
| 3,168,863 | 2/1965 | McRae | 101/DIG. 3 |
| 3,641,930 | 2/1972 | Riddington | 101/35 |
| 4,004,511 | 1/1977 | De Groot | 101/41 X |

FOREIGN PATENT DOCUMENTS

| | | | |
|---|---|---|---|
| 1,241,244 | 8/1971 | United Kingdom | 101/44 |

*Primary Examiner*—Clifford D. Crowder
*Attorney, Agent, or Firm*—Robert K. Youtie

[57] ABSTRACT

A printing mechanism including a carrier shiftable into and out of a limiting position toward and short of a surface to be printed, an inertia member carrying printing type and being carried by the carrier for movement therewith and inertial movement beyond the carrier into printing position, and resilient means operative to yieldably resist inertial movement of the inertia member and instantaneously return the latter on printing engagement.

8 Claims, 5 Drawing Figures

FIG. 3
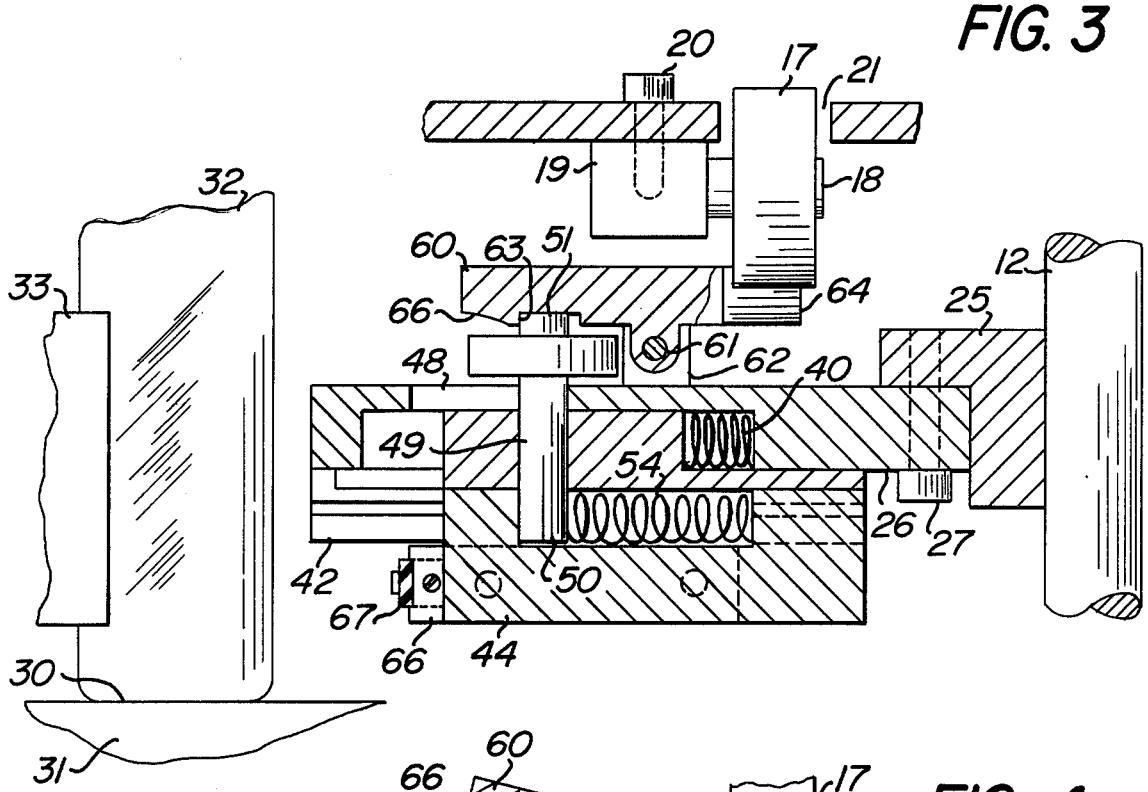
FIG. 4
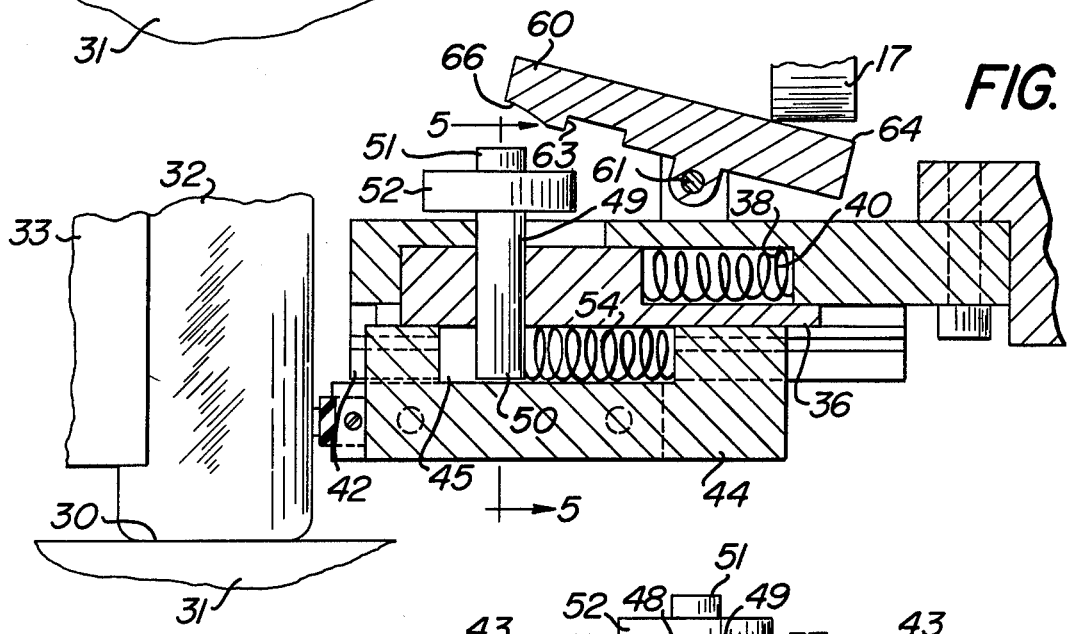
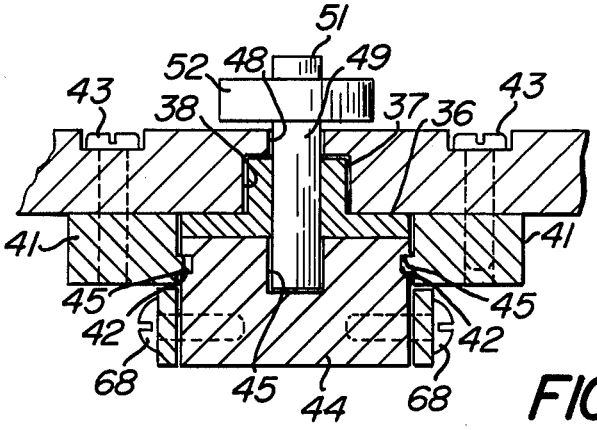
FIG. 5

INERTIA PRINTING MEMBER

BACKGROUND OF THE INVENTION

This invention relates generally to the field of printing mechanisms, and may be considered an improvement over the invention of Gery and Samson disclosed in U.S. Pat. No. 3,724,369, the device thereof limiting the speed of movement of articles being printed into and out of the printing station.

SUMMARY OF THE INVENTION

Accordingly, it is an important object of the present invention to provide a printing mechanism of the general type described above which substantially enhances the speed of printing to enable printed articles to be moved more rapidly into and out of a printing station, so that conveyor line speed is effectively increased.

It is another object of the present invention to provide a printing mechanism of the type described which effects a precise, accurate and high quality of printing, for long continuous periods of time, without the need for adjustment, and which can be achieved by a simple, sturdy and entirely reliable mechanism.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 3 is a partial sectional elevational view taken generally along the line 3—3 of FIG. 1, just prior to printing and enlarged for clarity.

FIG. 4 is a partial sectional elevational view similar to FIG. 3, at the moment of printing.

FIG. 5 is a partial sectional elevational view taken generally along the line 5—5 of FIG. 4.

DESCRIPTION OF THE PREFERRED EMBODIMENT

Figure 1:
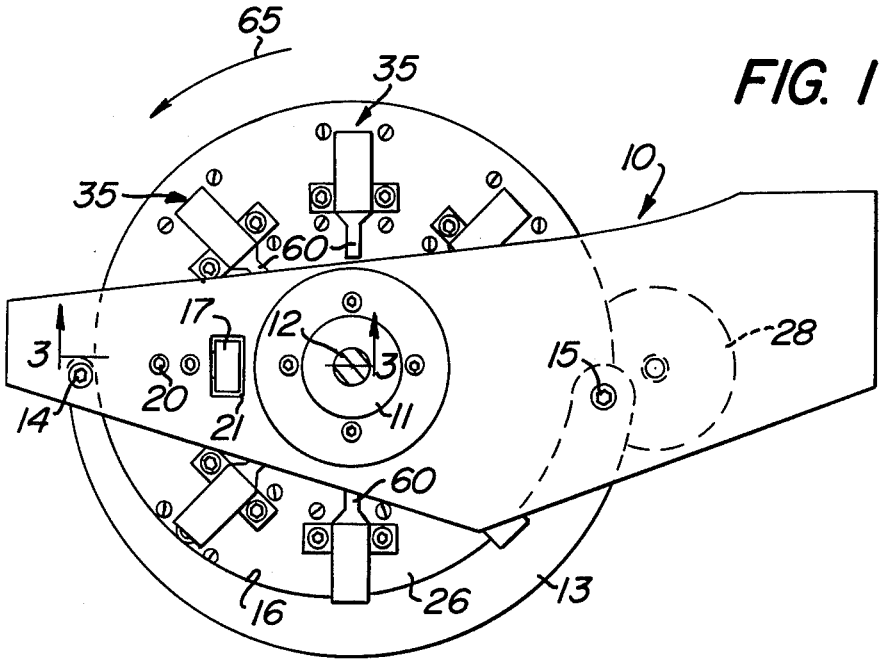
FIG. 1 is a top plan view showing a printing mechanism of the present invention.
Figure 2:
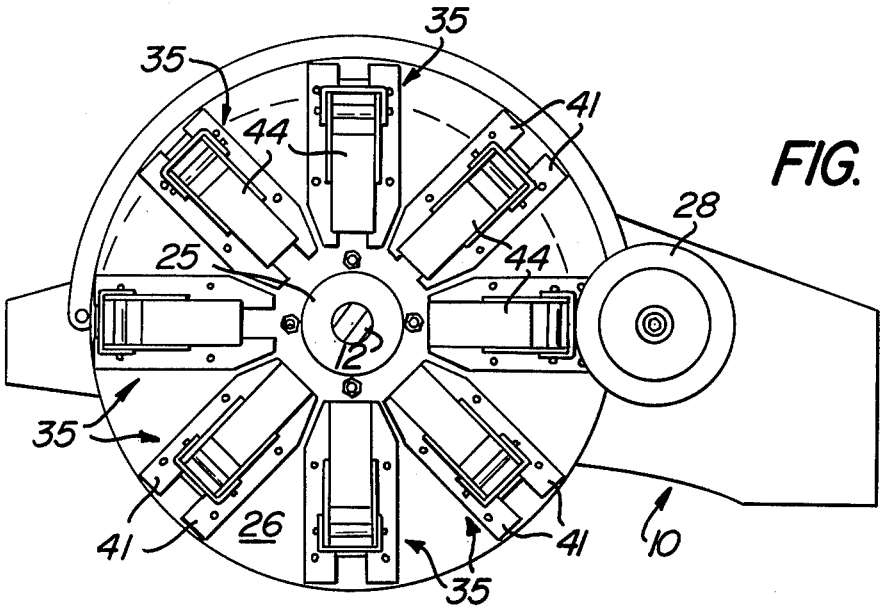
FIG. 2 is a bottom plan view of the mechanism shown in FIG. 1.

Referring now more particularly to the drawings, and specifically to FIGS. 1 and 2 thereof, a fixed overhead mounting plate is generally designated 10, and is suitably secured in generally horizontal disposition. The mounting member or plate 10 may be provided with a generally vertical shaft journal or bearing 11 for rotatably receiving an upright or vertical shaft 12. Extending generally concentrically about the axis of shaft 12, and carried by the overhead mounting plate 10 is a generally spiral or arcuate retraction member or cam 13, extending approximately 180° concentrically about the axis of shaft 12, and secured to the underside of the mounting plate 10, as by fasteners 14 and 15 at opposite ends of the retraction member. More specifically, the inner or concave edge 16 of cam 13 extends generally 180° about the axis of shaft 12 and is of spiral configuration, so as to be of gradually reducing radius of curvature, as between the end fastener 14 and the end fastener 15.

Also carried by the horizontal mounting plate 10, say between the outer end region of cam 13 and shaft 12 is an actuating member or roller 17, which may be rotatable about a generally horizontal axis, as of axle or pin 18, see FIG. 3, extending generally radially of the axis of shaft 12 and generally toward the outer end region of cam 13 proximate to fastener 14. The actuating means or roller 17 may be mounted on the underside of mounting plate 10, as by mounting block 19 and fasteners 20, and may project upwardly through an opening 21 in the mounting plate.

The vertical shaft 12 may depend from the underside of mounting plate 10 to a suitable lower shaft journal or bearing (not shown) and may carry intermediate its ends a hub 25. A generally circular, substantially horizontal support plate or table 26 may be circumposed about hub 25, being concentric with shaft 12 and suitably secured to the hub 25, as by fasteners 27. Thus, the generally horizontal support or circular table 26 is axially rotatable about the vertical axis of shaft 12, and suitable drive means may be connected to the shaft for effecting the desired rotation of support or table 26.

The generally arcuate retraction member 13 is located in a plane interposed between the plane of mounting plate 10 and circular support or table 26.

Also carried by the mounting plate 10, on the underside thereof and partially beneath the circular support table 26 is an inking roll 28, or other suitable printing media transfer means, for purposes appearing presently. The inking roll 28 may be located diametrically opposite to the actuating roll 17 and leading end of retraction member 13 adjacent to fastener 14. Also adjacent to the leading end of retraction member 13 is a printing station, as at 30, in FIGS. 3 and 4, which may be generally tangent to support 26 proximate to fastener 14 of cam 13. The printing station 30 may be located along the conveyor line of a container conveyor, such conveyor means being designated 31 supporting a container 32, and including container movement means 33.

The generally horizontal support 26 carries a plurality of printing assemblies arranged in a radial array about the axis of shaft 12. The printing assemblies are each generally designated 35, being disposed in a circle on the circular support plate 26, and each extending generally radially thereof.

The printing assemblies 35 each include a carrier plate or member 36 on the underside of support 26, having an upstanding boss or lug 37 slidably received in a downwardly facing radially disposed recess, groove or guideway 38. Thus, the carrier or plate 36 is radially shiftable inwardly and outwardly toward and away from the center axis or shaft 12. A primary resilient element or coil compression spring, as at 40, may be located in the guideway or recess 38, being interposed between the inner end of the guideway and the received carrier lug or slide portion 37 so as to resiliently urge the carrier radially outwardly.

Each printing assembly 35 may further include, fixedly secured on the underside of support plate 26, a pair of generally parallel, substantially radially disposed guides or way members 41, located on opposite sides of an intermediate carrier 36, and having inturned rails or lips 42. The guides 41 may be suitably affixed to the support 26, as by fastener 43.

An inertia member, body or block 44 is located immediately beneath each carrier 36, having its upper region received between the adjacent pair of guides or ways 41, and provided with a pair of opposed, laterally outwardly opening grooves 45 respectively and slidably receiving rails 42. Thus, the inertia member or body 44 is mounted beneath its adjacent carrier 36 and shiftable radially inwardly and outwardly toward and away from the axial shaft 12, both together with and relative to the carrier.

The inertia member 44 has its upper side facing toward the underside of carrier 36, and on the upper side of the inertia member there is formed an elongate, upwardly opening recess or groove 45 extending generally radially of the shaft 12 and having its upper side closed by the undersurface of the carrier. Directly over the recess or groove 45, and over the downwardly facing groove or recess 38 of the support 26, the support is formed with a through slot 48, which also extends radially of the shaft 12, but is of less length and has its ends terminating short of respective ends of the groove 38. A connection member or pin 49 extends in parallelism with shaft 12, conformably through carrier 36 and carrier lug 37 for lateral movement with the carrier radially of shaft 12. The lower end region 50 of connector pin 49 depends into upwardly facing groove or recess 45 of inertia member 44 for shiftable reception within the latter groove. The connection member 49 extends upwardly through slots 48 and therebeyond to terminate in an upstanding upper end region 51. The upstanding connector pin end region 51 may carry, spaced below the upper pin end, a rotary cam follower or roll 52.

It will thus be understood that the carrier 36 is shiftable radially of shaft 12 between its outermost, extended printing position of FIG. 4, as limited by engagement of lug 37 with the outer end of groove 38, or of connection member 49 with the outer end of slot 48, and is shiftable to an innermost retracted position shown in FIG. 3. In the retracted position of FIG. 3, the primary resilient means 40 is most compressed to store potential energy.

An additional, secondary resilient means, say a coil compression spring 54 may be located within the groove or recess 45, interposed between the radially inner end of the groove and the lower end region 50 of connection member 49. Thus, it will be apparent that coil compression spring 54 urges inertia member or body 44 radially inwardly to a position with lower connection member end 50 in limiting abutting engagement with the radially outer end of groove 45.

Each printing assembly further includes, on the upper side of support 26, a pivoted arm or latch 60 disposed generally radially of the support and mounted intermediate its ends for rotative movement about a pivot 61 extending generally normal to the radial direction of shaft 12. That is, each latch member 60 is rotatably supported by a pivot pin 61 which is in turn carried by upstanding pivot pin supports or lugs 62 on the upper side of support 26. Radially outward of its support pivot 61, each latch 60 is provided on its underside with a catch or hook 63 for retaining engagement with the upper end 51 of connection member 49, as seen in FIG. 3. The opposite, inner end of each latch 60, as at 64, is located to pass beneath the actuating roller 17 upon rotation of support 26, which roller depresses the nether portion 64 of latch 60 to swing the outer latch end upwardly and release connection pin 49, the condition shown in FIG. 4.

In addition, there is provided on the radially outer end of inertia member 44, a type mount 66, which removably carries printed type 67, as by fastener means 68 detachably securing the opposite ends of the type means to opposite sides of the inertia member.

In operation, the shaft 12 and hub 25, together with support 26, may rotate continuously, being driven by any suitable means, and articles 32, such as containers, may be moved sequentially into and out of the printing station 30 for printing on the articles, as shown in FIG. 4. Immediately following the instant of printing, as shown in FIG. 4, the inertia member 44 is retracted radially of the shaft 12, out of printing engagement with the article 32, by the resilient expanding action of the secondary resilient means 54. Specifically, the expansion of spring 54 in groove 45 causes the inertia member to shift rightward, as seen in FIG. 4, away from the relatively stationary connection member 49, which retractile movement is limited by engagement of the connection member with the outer end wall of groove 45. Continued rotation of support 26 in the direction of arrow 65, as seen in FIG. 1, effects radial retraction of connection member 45 by rolling engagement of cam follower or roll 52 with the spiral cam or retraction member 13. Radially retracted together with the connection member 49, against the resilient force of primary resilient means 40, is the carrier 36, to the position shown in FIG. 3. Together with the carrier 36, the inertia member 44 is also retracted to the position shown in FIG. 3. This condition of full retraction occurs during the approximately 180° printing assembly rotation along cam 13; and, during this retraction, the upper end 51 of connection member 49 slides beneath latch 60, as by engagement along the oblique latch surface 66 to snap into retained engagement with the catch 63.

Thus, the printing assembly 35 shown in FIG. 3 may be considered as in a fully retracted or cocked condition preparatory to release for its printing operation. In the fully retracted printing assembly condition, the printing assemblies may each pass the inking wheel 28, with the inking member in rolling engagement with the type face 67.

Upon movement of each printing assembly into the position adjacent to the printing station, the inner latch end 64 engages beneath and is depressed by the actuating roll 17, thereby raising the outer latch end and hook or catch 63 out of retaining engagement with the connection member 49. This releases the associated carrier 36 for spring biased propulsion radially outwardly under the force of primary resilient means 40 to its limiting abutment position shown in FIG. 4. The inertia member 44 is free to continue radially outward movement by its inertia force, against the resilient resistance of secondary spring means 54 until the type means 67 arrives in printing engagement with an article 32 at the printing station 30. This is the condition shown in FIG. 4, which is only an instantaneous or momentary condition. Immediately upon arriving at the printing condition shown in FIG. 4, the secondary resilient member or spring 54 operates to retract the inertia member out of its printing engagement to the limiting position with the lower end 50 of connection member 49 engaging the outer end of groove 45.

With the container printing operation thus accomplished, retraction of the printing assembly 35, as described hereinbefore, proceeds for repetition of the cycle.

It will therefore be appreciated that the conveyor line represented at 31 may be of any suitable type carrying a plurality of containers 32, as by appropriate container movement means 33 successively into the printing station 30.

The horizontal support plate or circular table 26 may also be considered as a conveyor of an endless, closed or circular path carrying the several printing assemblies or mechanisms 35 disposed radially of the path and radially extensile and retractile with respect to the path. The several printing mechanisms 35 are successively operated, each being operated through its printing step at the printing station 30 for printing engagement with the respective container 32 located at the printing station. Heretofore, as in said U.S. Pat. No. 3,724,369 to Gery et al, speed of the container-carrying conveyor was limited by the required cycling time of the printing mechanism. However, in the instant invention the operational cycle of each printing mechanism 35, except the printing step which occurs at the printing station 30, is accomplished during movement of the printing mechanisms through the remainder of the path of conveyor plate 26. More specifically, the printing mechanisms 35 are each retracted during movement away from the printing station, re-inked in a retracted position, and retained retracted by the latch 16 during movement toward the printing station, for release into printing position at the printing station. By this means, ample time is afforded for the complete operating cycle of each printing assembly 35, while permitting the successive printing assemblies to be moved with relatively high speed into the printing station for the printing step.

From the foregoing, it will now be understood that the device of the present invention provides a printing mechanism which is capable of greatly increased printing speeds, so that conveyor lines may move with great rapidity, that printing is effected with high precision and quality with very little maintenance required, and which otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A printing mechanism for printing an article at a printing station and comprising a support, a carrier mounted on said support for shifting movement into and out of an extended position toward a printing station, an abutment located for abutting engagement with said carrier to limit its shifting movement to said extended position, primary resilient means urging said carrier toward said extended position, latch means on said support and carrier releasably holding the latter in a retracted position away from the printing station against the force of said primary resilient means, an inertia member carried by said carrier for movement therewith and mounted on said carrier for shifting movement relative thereto toward and away from the printing station, type means on said inertia member for movement therewith into and out of printing engagement with an article at the printing station, secondary resilient means urging said inertia member to a retracted position relative to said carrier away from the printing station, positive retraction means movable relative to said support, connection means between said retraction means and carrier for retracting the latter to its retracted position, and latch release means for disengaging the latch means, whereby disengagement of the latching means releases said carrier for movement to its extended position together with said inertia member which continues inertially relative to said carrier against the force of said second resilient means into type printing engagement with an article and instantaneously retracts by the force of said second resilient means, said support being movable past the printing station, and said retraction means being operative upon support movement beyond the printing station to retract the carrier after printing.

2. A printing mechanism for printing an article at a printing station and comprising a support, a carrier mounted on said support for shifting movement into and out of an extended position toward a printing station, an abutment located for abutting engagement with said carrier to limit its shifting movement to said extended position, primary resilient means urging said carrier toward said extended position, latch means on said support and carrier releasably holding the latter in a retracted position away from the printing station against the force of said primary resilient means, an inertia member carried by said carrier for movement therewith and mounted on said carrier for shifting movement relative thereto toward and away from the printing station, type means on said inertia member for movement therewith into and out of printing engagement with an article at the printing station, secondary resilient means urging said inertia member to a retracted position relative to said carrier away from the printing station, positive retraction means movable relative to said support, connection means between said retraction means and carrier for retracting the latter to its retracted position, and latch release means for disengaging the latch means, whereby disengagement of the latching means releases said carrier for movement to its extended position together with said inertia member which continues inertially relative to said carrier against the force of said second resilient means into type printing engagement with an article and instantaneously retracts by the force of said second resilient means, said connection means comprising a projection from said carrier for engagement with said retraction means, and said latch means comprising a latch member, and a formation on said projection for interengagement with said latch means.

3. A printing mechanism for printing an article at a printing station and comprising a support, a carrier mounted on said support for shifting movement into and out of an extended position toward a printing station, primary resilient means urging said carrier toward said extended position, latch means on said support and carrier for releasably holding the latter in a retracted position away from the printing station against the force of said primary resilient means, an inertia member carried by said carrier for movement therewith and mounted on said carrier for shifting movement relative thereto toward and away from the printing station, type means on said inertia member for movement therewith into and out of printing engagement with an article at the printing station, and secondary resilient means urging said inertia member to a retracted position relative to said carrier away from the printing station, whereby disengagement of the latching means releases said carrier for movement to its extended position together with said inertia member which continues inertially relative to said carrier against the force of said second resilient means into type printing engagement with an article and instantaneously retracts by the force of said second resilient means, said support being movable past the printing station, and said retraction means being operative upon support movement beyond the printing station to retract the carrier after printing, and latch release means located in position to release said latch means upon support movement to the printing station.

4. A printing mechanism according to claim 3, said support comprising a rotary table generally tangent to the printing station, said carrier being shiftable generally radially of said table, said inertia member being shiftable relative to said carrier generally radially of said table, and said retraction means comprising a fixed cam extending along said table for camming said carrier to its retracted position.

5. A printing apparatus comprising a first conveyor for successively carrying articles to be printed into and out of a printing station, a second conveyor movable along a closed path past said printing station, a plurality of printing mechanisms arranged along said closed path and carried by said second conveyor for movement about said closed path successively past said printing station, and control means associated with said printing mechanisms to control each printing mechanism through its operating cycle upon movement about said closed path with the printing step of the cycle occurring at the printing station and the remaining steps occurring along the remainder of the closed path, said printing mechanisms each comprising a carrier carried by said second conveyor for movement therewith and shifting movement relative thereto into and out of an extended position toward said printing station, and an abutment located for abutting engagement with said carrier to limit its shifting movement to said extended position, primary resilient means urging said carrier toward said extended position, latch means on said second conveyor and carrier releasably holding the latter in a retracted position away from the printing station against the force of said primary resilient means, and an inertia member carried by said carrier for movement therewith and mounted on said carrier for shifting movement relative thereto toward and away from the printing station, type means on said inertia member for movement therewith into and out of printing engagement with an article at the printing station, secondary resilient means urging said inertia member to a retracted position relative to said carrier away from the printing station, and latch release means for disengaging the latch means.

6. A printing apparatus according to claim 5, said second conveyor being generally circular for carrying said printing mechanisms along a generally circular closed path generally tangent to said printing station.

7. A printing apparatus according to claim 5, cam means for retracting said printing mechanisms upon movement away from said printing station, said latch means retaining said printing mechanisms retracted upon movement toward said printing station.

8. A printing apparatus according to claim 5, said printing mechanisms being arranged generally radially of said second conveyor and radially extensile into printing position at said printing station and contractile out of said printing position.

* * * * *